United States Patent [19]

Watanabe

[11] Patent Number: 4,772,913

[45] Date of Patent: Sep. 20, 1988

[54] IMAGE FORMING METHOD & APPARATUS WITH VARIABLE FIXING PRESSURE IN A MULTIPLE COPY MODE

[75] Inventor: Junji Watanabe, Yokohama, Japan

[73] Assignee: Kabushiki Kaisha Toshiba, Kawasaki, Japan

[21] Appl. No.: 88,037

[22] Filed: Aug. 19, 1987

Related U.S. Application Data

[63] Continuation of Ser. No. 691,140, Jan. 14, 1985, abandoned.

[30] Foreign Application Priority Data

Jan. 18, 1984 [JP] Japan ..... 59-5708

[51] Int. Cl.[4] ..... G03G 15/20

[52] U.S. Cl. ..... 355/3 FU; 355/4

[58] Field of Search ..... 355/14 FU, 3 FU, 3 R, 355/4, 3 DD

[56] References Cited

U.S. PATENT DOCUMENTS

| | | | |
|---|---|---|---|
| 3,906,897 | 9/1975 | Davidson . | |
| 3,960,445 | 6/1976 | Drawe | 355/4 |
| 3,988,061 | 10/1976 | Root | 355/3 FU X |
| 4,098,551 | 7/1978 | Komori et al. | 355/3 R |
| 4,099,484 | 4/1978 | Ohno | 100/168 X |
| 4,427,285 | 1/1984 | Stange | 355/3 FU |
| 4,429,987 | 2/1984 | Chang et al. | 355/14 FU |
| 4,541,705 | 9/1985 | Knechtel | 355/3 FU |

FOREIGN PATENT DOCUMENTS

| | | | |
|---|---|---|---|
| 262608B2 | 12/1976 | Fed. Rep. of Germany . | |
| 2705846A1 | 8/1977 | Fed. Rep. of Germany . | |
| 2950516A1 | 4/1980 | Fed. Rep. of Germany . | |
| 3221059A1 | 12/1983 | Fed. Rep. of Germany . | |
| 58-142363 | 8/1983 | Japan | 355/14 FU |

*Primary Examiner*—Arthur T. Grimley
*Assistant Examiner*—J. Pendegrass
*Attorney, Agent, or Firm*—Cushman, Darby & Cushman

[57] ABSTRACT

An electrostatic latent image formed on an image carrier is developed and then transferred to a paper sheet. In a normal copy mode, the image transferred to the paper sheet is fixed at a relatively high pressure, and in a multiple super position mode, it is fixed at a relatively low pressure. Thereafter, the paper sheet is conveyed again to a step for trasferring another image.

8 Claims, 16 Drawing Sheets

IMAGE FORMING METHOD & APPARATUS WITH VARIABLE FIXING PRESSURE IN A MULTIPLE COPY MODE

This is a continuation of application Ser. No. 691,140, filed Jan. 14, 1985, which was abandoned upon the filling hereof.

BACKGROUND OF THE INVENTION

1. Field of the Invention

The present invention relates to an image forming method and apparatus in which a plurality of copy operations are performed on a single paper sheet.

2. Description of the Prior Art

Recently, copy machines have been provided with a plurality of developers storing toners of different colors so as to perform a plurality of copy operations on a single paper sheet, thereby forming a multiple super position, or multiple copy, mode. In this case, a paper sheet exhausted from a fixing device is returned to register rollers in front of a photosensitive drum so as to perform a multiple super position operation. In such a copy machine, a heat roller is used as the fixing device. The heat roller is formed into an hourglass shape in which diameters of two end portions thereof are larger than that of a central portion so as to apply tension on the paper sheet along a direction perpendicular to a feeding direction. Because of this, the paper sheet passing through the fixing device is wrinkled along the direction perpendicular to the feeding direction. When the paper sheet is returned so as to form a multiple super position, a paper jam easily occurs and a copy position can be undesirably shifted.

In addition to a multiple super position machine described above, a copy machine which copies on two sides of a single paper sheet by reconveying the sheet is known. However, in such a copy machine, the same problem as described above occurs.

SUMMARY OF THE INVENTION

It is an object of the present invention to provide an image forming method and apparatus in which even when a plurality of copy operations are performed on a single paper sheet, the paper sheet is not wrinkled and a paper jam is prevented, and an image can be formed with high precision.

According to the present invention, there is provided an image forming method and apparatus where an electrostatic latent image formed on an image carrier is developed with a selected color and is transferred to a paper sheet. In a normal copy mode, the image on the paper sheet is fixed by the apparatus at a relatively high pressure P2. In a multiple super position mode, the image on the paper sheet is fixed at a relatively low pressure P1. Thereafter, the paper sheet is conveyed to a transfer means in either case.

According to the present invention, there is provided an image forming method and apparatus wherein the paper sheet is not wrinkled and a paper jam is prevented when a plurality of image forming operations are performed on a single paper sheet, and an image can be precisely formed.

DETAILED DESCRIPTION OF THE PREFERRED EMBODIMENTS

An image forming method of the present invention will be described hereinafter with reference to the accompanying drawings.

Figure 1:
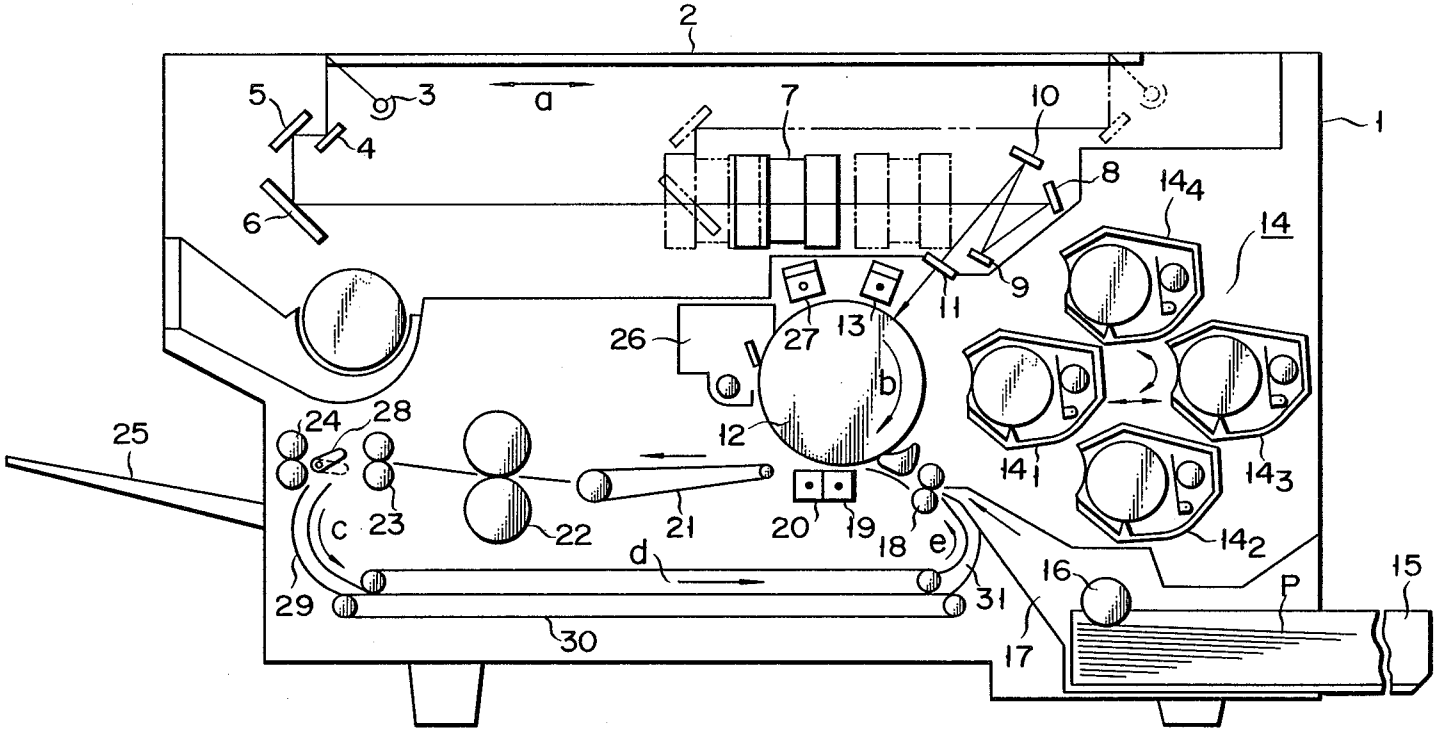
FIG. 1 is a side sectional view showing an apparatus according to an image forming method of the present invention.
Figure 2:
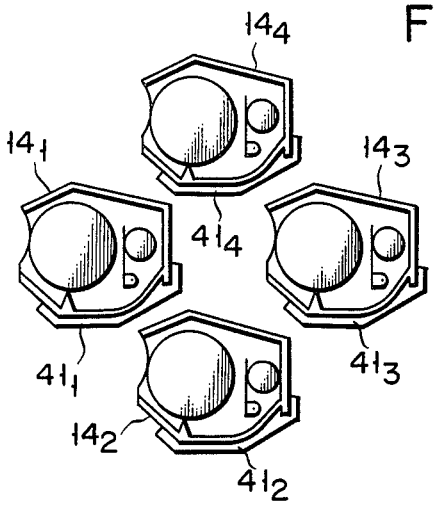
FIGS. 2 and 3 are, respectively, views for explaining an operation of a developing unit of a copy machine shown in FIG. 1.

FIG. 1 is a side sectional view showing a copy machine according to an embodiment of the present invention.

A document table 2 for supporting a document is provided on an upper surface of a copy machine housing 1. An optical system consisting of an exposure lamp 3 and mirrors 4 to 6 is reciprocated along a lower surface of the document table 2 along a direction indicated by an arrow a. Thus, an image on the document is optically scanned. In this case, in order to keep constant an optical path length from the exposure lamp 3 to a lens block 12, the mirrors 5 and 6 are moved half the distance of movement of the mirror 4 along the same direction thereof.

The document is irradiated with light from the exposure lamp 3, and the light reflected from the document is reflected by the respective mirrors 4 to 6 and is irradiated on a lens block 7 for setting a copy magnification. The reflected light which is reduced or enlarged at a selected magnification is reflected by mirrors 8 to 10 and passes through a slit 11. Thereafter, the reflected light reaches an image carrier, e.g., a photosensitive drum 12. Thus, the image on the document is formed on a surface of the photosensitive drum 12. When the optical system moves to scan the document, the photosensitive drum 12 rotates along a direction indicated by an arrow b. The surface of the photosensitive drum 12 is charged by a charger 13. Therefore, when the image on the document is slit-exposed, an electrostatic latent image is formed on the surface of the photosensitive drum 12. Toner is coated on the latent image by a developing unit 14 so as to visualize the image.

Paper sheets P are fed one by one from a paper feed cassette 15 by a paper feed roller 16 and are guided to a pair of register rollers 18 through a paper guide path 17. The paper sheet P is aligned by the register rollers 18 and is fed to an image transfer section. (Note that the paper feed cassette 15 is detachably mounted at a lower-right portion of the housing 1.)

The paper sheet P which is fed to the image transfer section is charged by a transfer charger 19 and is attached to the surface of the photosensitive drum 12, thereby transferring the toner image thereon.

After fixing, the paper sheet P is fed to a pair of exhaust rollers 24 by a pair of conveyor rollers 23 so as to be exhausted on a tray 25 located outside the housing 1. Residual toner on the photosensitive drum 12 after transfer is removed by a cleaner 26, and a residual image thereon is erased by a erase lamp 27, thus returning it to an initial state.

A guide selector 28 for controlling a convey direction of the paper sheet P is provided between the conveyor rollers 23 and the exhaust rollers 24. In a normal copy mode, the guide selector 28 guides the paper sheet P fed by the conveyor rollers 23 to the exhaust rollers 24. However, in a multiple super position mode, the guide selector 28 guides the paper sheet P to a paper guide path 29 which guides the paper sheet P to a lower portion of the housing 1. The paper sheet P guided on the paper guide path 29 is guided to a conveyor 30 provided at a bottom portion of the housing 1. The paper sheet P is conveyed to a position near the paper feed cassette 15 by the conveyor 30 and is fed to the register rollers 18 through a paper guide path 31. In the multiple super position mode, the paper sheet P is sequentially conveyed along directions indicated by arrows c, d and e in FIG. 1.

The developing unit 14 comprises, for example, four developers $14_1$ to $14_4$. The four developers $14_1$ to $14_4$ are held at a position which is at a predetermined distance from a rotating axis thereof so as to be parallel and rotatable with respect thereto. Therefore, the developers $14_1$ to $14_4$ revolve parallel to each other, and the desired developer is selected. The developing unit 14 can be brought into contact with or separated from the photosensitive drum 12 by a moving unit (not shown). In other words, in a copy operation, the developing unit 14 is positioned away from the photosensitive drum 12, as shown in FIG. 1. When a developer is selected, the developing unit 14 is moved toward the photosensitive drum 12. When the selection of the developers is completed, the developing unit 14 moves back to its original position away from the photosensitive drum 12. Thus, the developing unit 14 sets the selected developer at a position opposite to the photosensitive drum 12.

Figure 3:
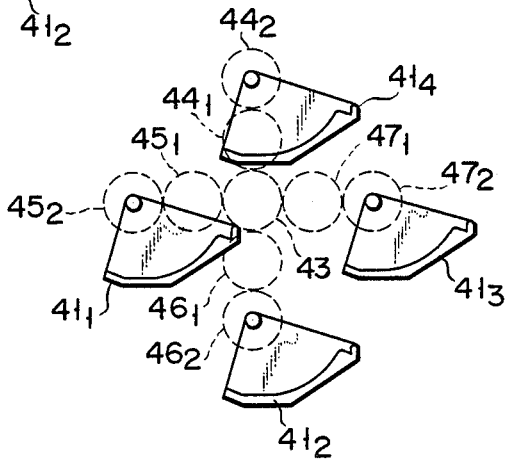
Figure 4:
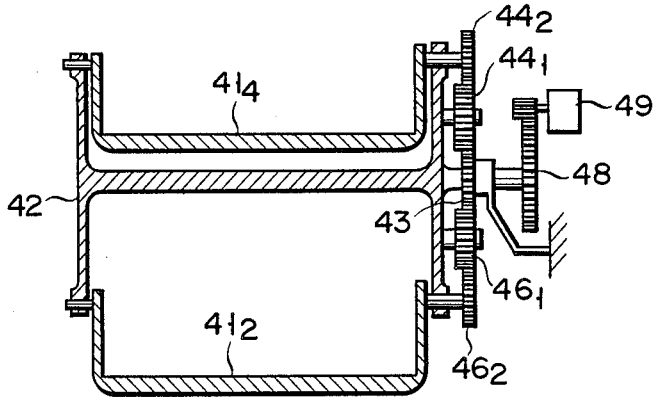
FIG. 4 is a front sectional view showing the developing unit of the copy machine shown in FIG. 1.
Figure 5:
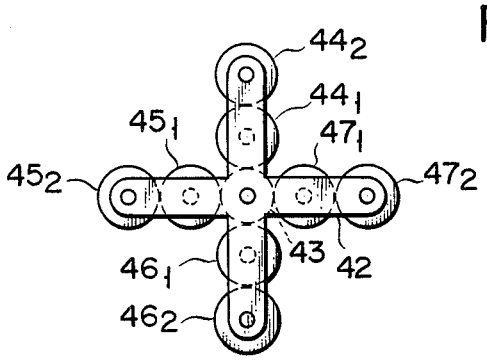
FIG. 5 is a front view showing a portion of a rotating frame of the developing unit shown in FIG. 4.

The developing unit 14 will be described with reference to FIGS. 2 to 7 hereinafter. For example, as shown in FIG. 3, four developer receivers $41_1$ to $41_4$ are provided. The developers $14_1$ to $14_4$ are held by the corresponding developer receivers $41_1$ to $41_4$. Note that the developer $14_1$ stores, e.g., black toner, the developer $14_2$ stores, e.g., red toner, the developer $14_3$ stores, e.g., green toner, and the developer $14_4$ stores, e.g., blue toner. The developer receivers $41_1$ to $41_4$ are affixed to a cross-shaped rotating frame 42, as shown in FIGS. 4 and 5. The rotating frame 42 is rotatable about a central shaft of a fixed gear 43, and four sets of planetary gears $44_1$, $44_2$, $45_1$, $45_2$, $46_1$, $46_2$, $47_1$ and $47_2$ are arranged around the fixed gear 43. These planetary gears are provided on the rotating frame 42 in pairs. The developer receivers $41_1$ to $41_4$ are fixed to corresponding rotating shafts of the outer gears $44_2$, $45_2$, $46_2$ and $47_2$.

The gears 43, $44_1$, $44_2$, $45_1$, $45_2$, $46_1$, $46_2$, $47_1$ and $47_2$ respectively have the same number of teeth. Therefore, since the gear 43 is fixed, even when the rotating frame 42 is rotated, the gears $44_2$, $45_2$, $46_2$ and $47_2$ do not rotate about their axes. For this reason, the developers $14_1$ to $14_4$ held by the developer receivers $41_1$ to $41_4$ revolve parallel to each other. Thus, the toner particles in the developers $14_1$ to $14_4$ will not spill therefrom. The rotating frame 42 is rotated by a pulse motor 49 through a reduction gear mechanism 48 such as a gear so as to select the desired developer.

Figure 6:
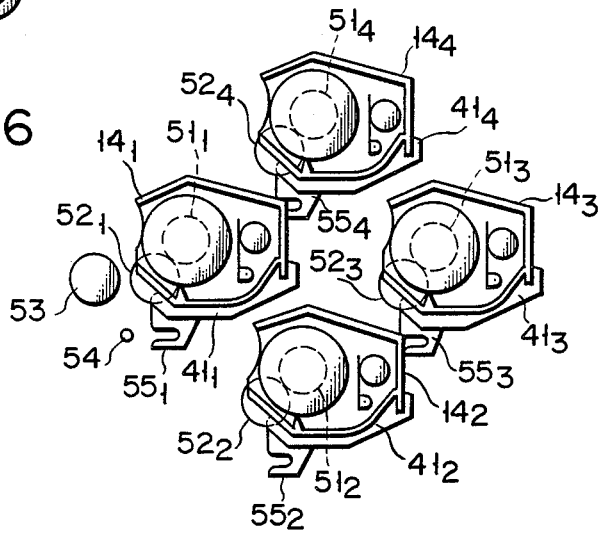
FIG. 6 is a side view showing a position aligning mechanism of developers for aligning them with respect to a photosensitive drum of the copy machine shown in FIG. 1.
Figure 7:
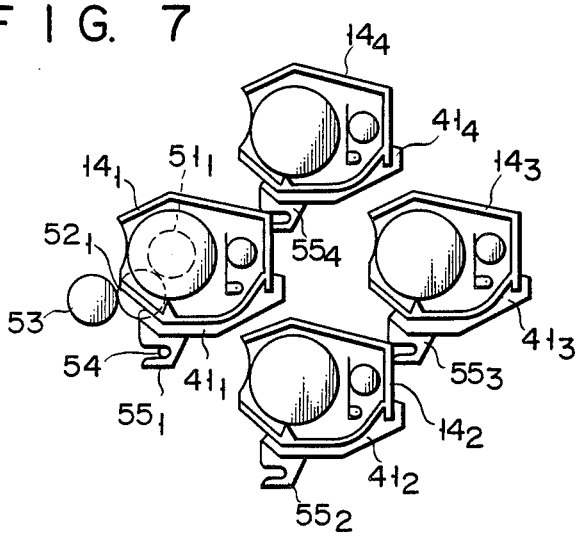
FIG. 7 is a side view showing a driving mechanism of the developers of the copying machine shown in FIG. 1.

As shown in FIG. 6, the developers $14_1$ to $14_4$ comprise developer gears $51_1$ to $51_4$ for driving a developer roller and idler gears $52_1$ to $52_4$, respectively. A driving gear 53 for driving the developers is provided at the housing 1 side. When the developing unit 14 approaches the photosensitive drum 12, the gear 53 meshes with the gears $52_1$ to $52_4$ so as to transmit a driving force to the gears $52_1$, $52_2$, $51_1$, $51_2$ in the order named. A guide pin 54 is fixed to the housing 1 side and guide members $55_1$ to $55_4$ are fixed to the corresponding developer receivers $41_1$ to $41_4$ of the developers $14_1$ to $14_4$.

Therefore, when the developing unit 14 approaches the photosensitive drum 12, it is smoothly and precisely guided so as to obtain a precise positional relationship between the photosensitive drum 12 and the selected developer.

Figure 8:
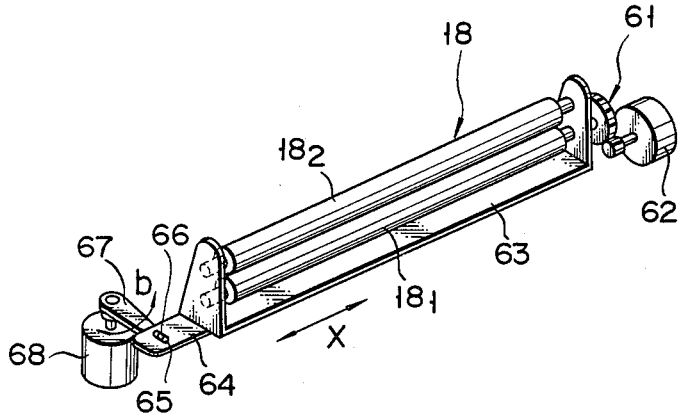
FIG. 8 is a perspective view showing register rollers of the copy machine shown in FIG. 1.
Figure 9:
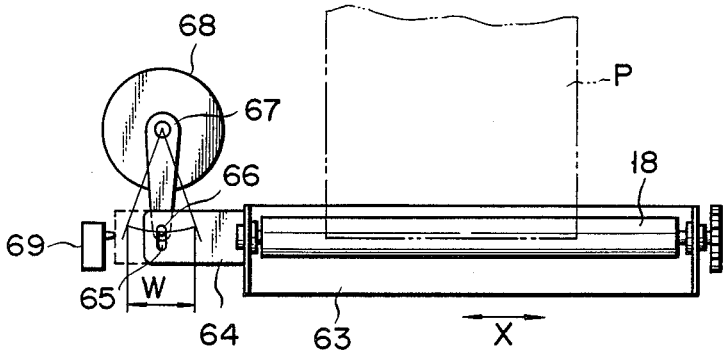
FIG. 9 is a plan view showing a portion of the register roller section shown in FIG. 8.

FIGS. 8 and 9 are views showing the register rollers 18 and the driving means thereof in more detail. The register rollers 18 consist of lower and upper rollers $18_1$ and $18_2$. The lower roller $18_1$ is driven by a paper feed pulse motor 62 through a reduction gear mechanism 61 such as a gear. The lower and upper rollers $18_1$ and $18_2$, the reduction gear mechanism 61 and the motor 62 are arranged on a frame 63. The frame 63 is moved reciprocally along an axial direction of the register rollers 18 by a mechanism (not shown). A frame link 64 projects from one end of the frame 63 toward the axial direction of the register rollers 18 and has an elongated hole 65. A pin 66 is inserted in the elongated hole 65 and is fixed to one end (distal end) of a lever 67. The other end of the lever 67 is fixed to a rotating shaft of an aligning pulse motor 68.

When the motor 68 is rotated, the lever is pivoted along a direction indicated by an arrow f in FIG. 8. Thus, a pivotal displacement of the lever 67 is converted into a displacement along the frame 63, i.e., along the axial direction (X direction) of the register rollers 18. Note that in FIG. 9, reference symbol W denotes a maximum displacement range of the register rollers 18.

An initial position of the aligning pulse motor 68 must be detected when power is supplied. For this purpose, a microswitch 69 is provided at a position opposing the distal end of the frame link 64. When power is supplied, the frame 63 is moved until the microswitch 69 is turned on, and is further moved to a predetermined reference position with reference to the position at which the microswitch 69 is turned on. Therefore, since the register rollers 18 are located at the reference position, when the paper sheet P is aligned and engaged by the rollers 18, it can be moved along the axial direction of the rollers 18 by driving the motor 68.

Figure 10:
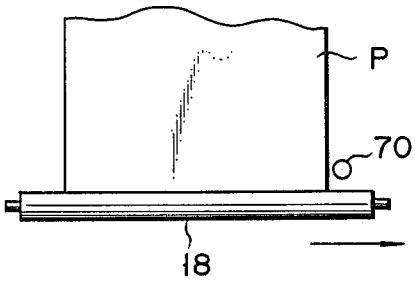
FIGS. 10 and 11 are plan views for explaining an aligning operation along an axial direction by the register rollers.

Alignment of the paper sheet P along the axial direction (X direction) of the register rollers 18 will be described with reference to FIGS. 10 and 11. A detector 70 for detecting the paper sheet P fed from the paper feed cassette 15 is of, for example, an optical transmission type. When the paper sheet P is engaged by the register rollers 18 in the state shown in FIG. 10, the detector 70 does not detect the paper sheet P. Therefore, the register rollers 18 are moved along a direction indicated by an arrow in FIG. 10 until the detector 70 detects the paper sheet P.

Figure 11:
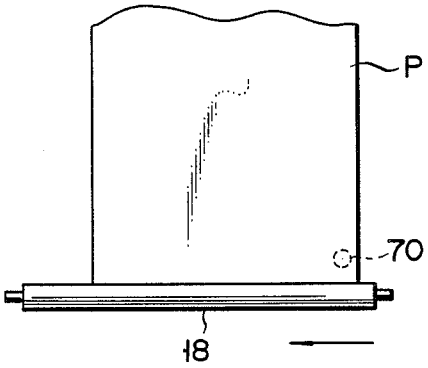
Figure 12:
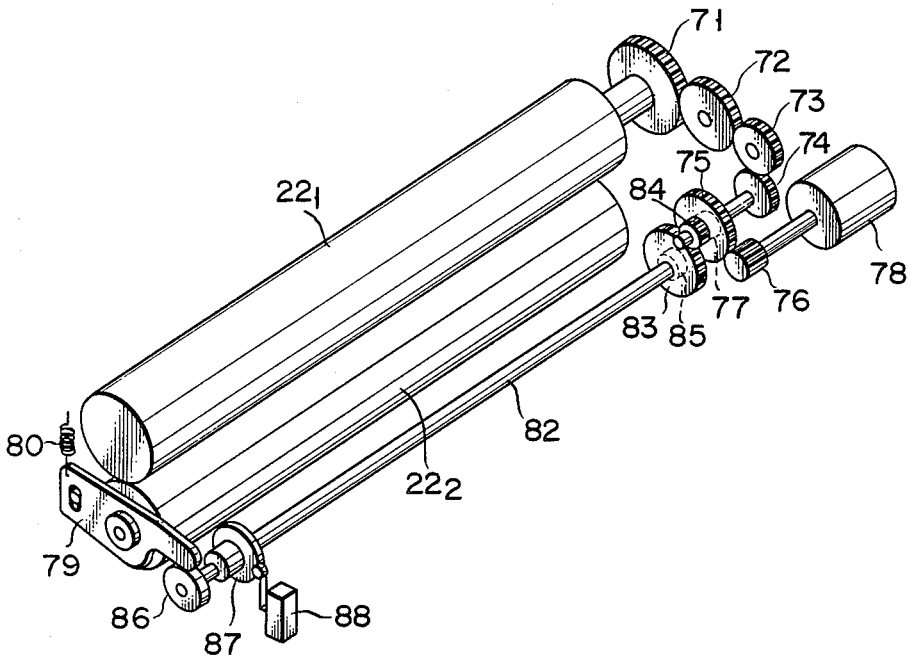
FIGS. 12 and 13 are perspective views showing a fixing unit and a driving mechanism thereof of the copy machine shown in FIG. 1.
Figure 13:
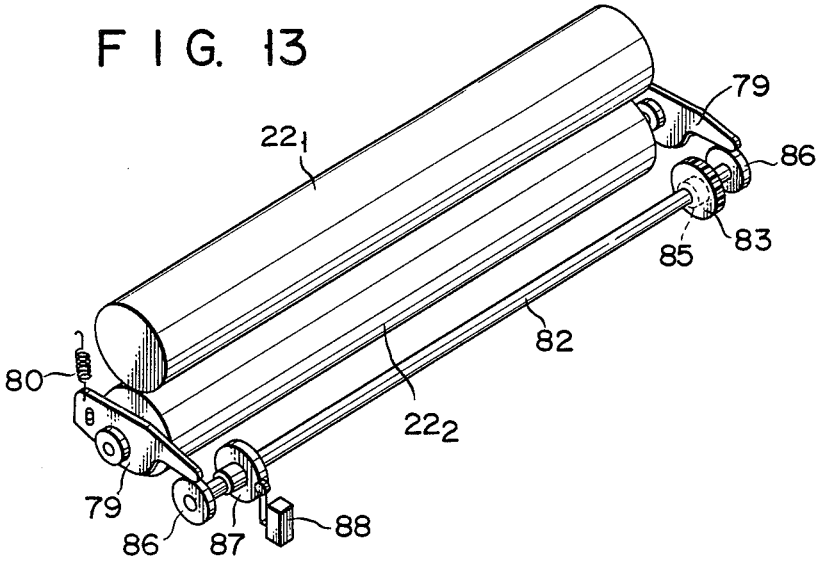

When the paper sheet P is engaged by the register rollers 18 in the state shown in FIG. 11, since the detector 70 detects the paper sheet P, the register rollers 18 are moved along a direction indicated by an arrow in FIG. 11 until the detector 70 does not detect the paper sheet P. In this manner, the detector 70 is movable with respect to the frame 63, and is fixed at a position at which the paper sheet P is to be aligned, thereby reliably aligning the paper sheet P at a predetermined position.

FIGS. 12 to 16 are views respectively showing the fixing unit 22 and the driving means thereof. The fixing unit 22 comprises upper and lower heat rollers $22_1$ and $22_2$. The upper heat roller $22_1$ is driven by, e.g., a fixing DC brushless motor 78 through a reduction gear/transmission means comprising gears 71, 72, 73, 74, 75 and 76 and a one-way clutch 77. The lower heat roller $22_2$ is urged against the upper heat roller $22_1$ by arms 79 which also serve as cam plates and biasing springs 80 so as to be rotated in accordance with the rotation of the upper heat roller $22_1$.

The paper sheet P onto which the toner image is transferred is conveyed to the heat rollers 22 by a conveyor belt 21 and is pressed between the upper and lower heat rollers $22_1$ and $22_2$ whose surface is kept at a constant temperature of, e.g., 190 degrees by a heater (not shown), thereby fixing the image formed thereon. The paper sheet P is then conveyed to the conveyor rollers 23.

The conveyor belt 21 is driven by a belt roller 81. A shaft of the roller 81 is connected to those of the gears 74 and 75 and is driven by the motor 78 along a direction indicated by an arrow g in FIG. 14. The conveyor rollers 23 are also driven by the motor 78 together with the conveyor belt 21. A cam shaft 82 is driven by the motor 78 through a reduction gear/transmission means comprising gears 83, 84, 75 and 76 and a one-way clutch 85. The cam shaft 82 is parallel to the lower heat roller $22_2$ and has eccentric cams 86 at two end portions opposite to the arms 79. Only when the motor 78 is rotated along a direction indicated by an arrow h in FIG. 14 upon operation of the clutch 85, the cams 86 push up the arms 79, thus biasing or removing the lower heat roller $22_2$ against or from the upper heat roller $22_1$.

Figure 14:
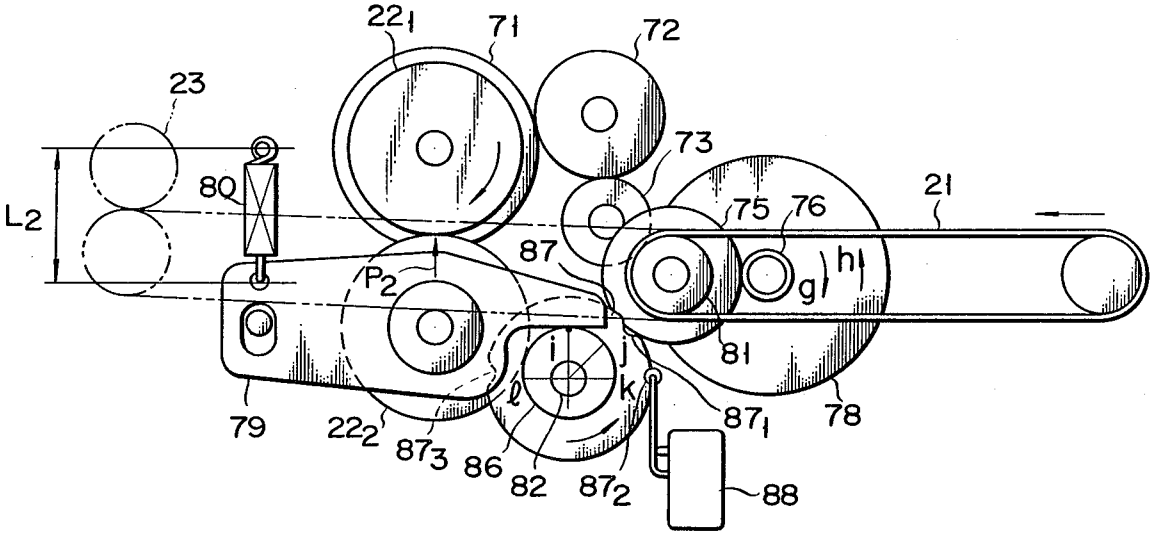
FIGS. 14 to 16 are sectional views showing the fixing unit and the driving mechanism, thereof, shown in FIG. 12.

Pressing operation of the heat rollers $22_1$ and $22_2$ will be described with reference to FIGS. 14 to 16 hereinafter. Although the lower heat roller $22_2$ is vertically moved by the cams 86, the position thereof is determined by a switching cam 87 which is mounted on the shaft 82 and a microswitch 88 which is turned on/off by the cam 87. Recesses $87_1$, $87_2$ and $87_3$ are formed in a peripheral portion of the cam 87. When a distal end of an actuator of the microswitch 88 is received in one of the recesses $87_1$, $87_2$ and $87_3$, the switch 88 is operated so as to detect the position of the cams 86. FIG. 14 shows a state wherein a point i of the cam 86 is at an upper dead point thereof at which the cam 86 pushes the lower heat roller $22_2$ to an uppermost position. At this position, a pressure between the upper and lower heat rollers $22_1$ and $22_2$ is a maximum value P2. Note that the position of the cam 87 is determined at a point k (the recess $87_2$) by the microswitch 88.

Figure 15:
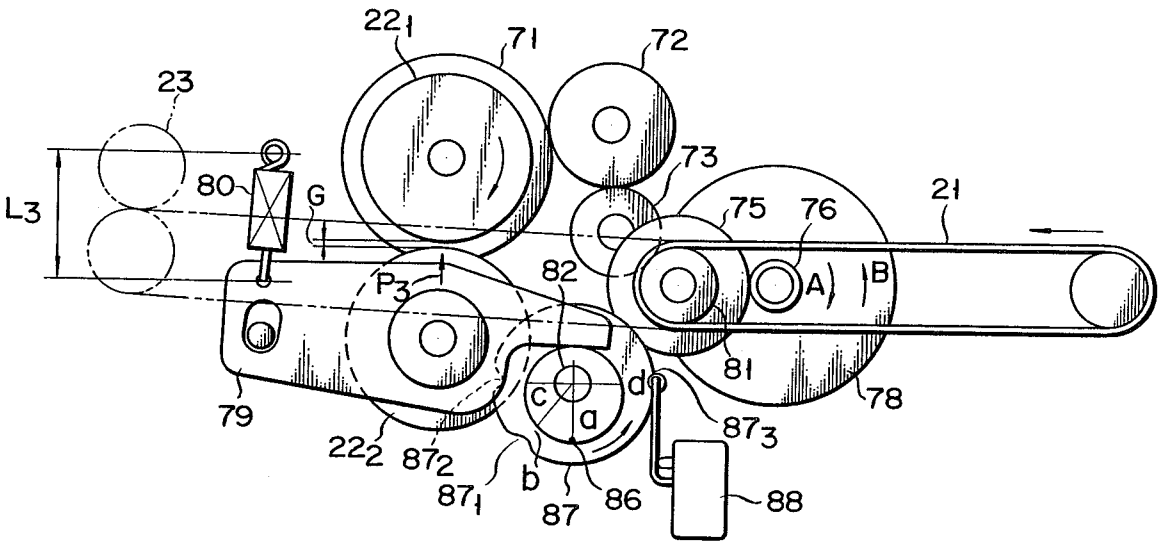

FIG. 15 shows the state wherein the lower heat roller $22_2$ is separated from the upper heat roller $22_1$. In this case, a point a of the cam 86 is at a lower dead point thereof at which the upper and lower heat rollers $22_1$ and $22_2$ form a gap G therebetween, resulting in easy maintenance in case of a paper jam. In this case, a position of the cam 87 is determined at a point l (the position opposite to the point k; i.e., the recess $87_3$) by the microswitch 88.

Figure 16:
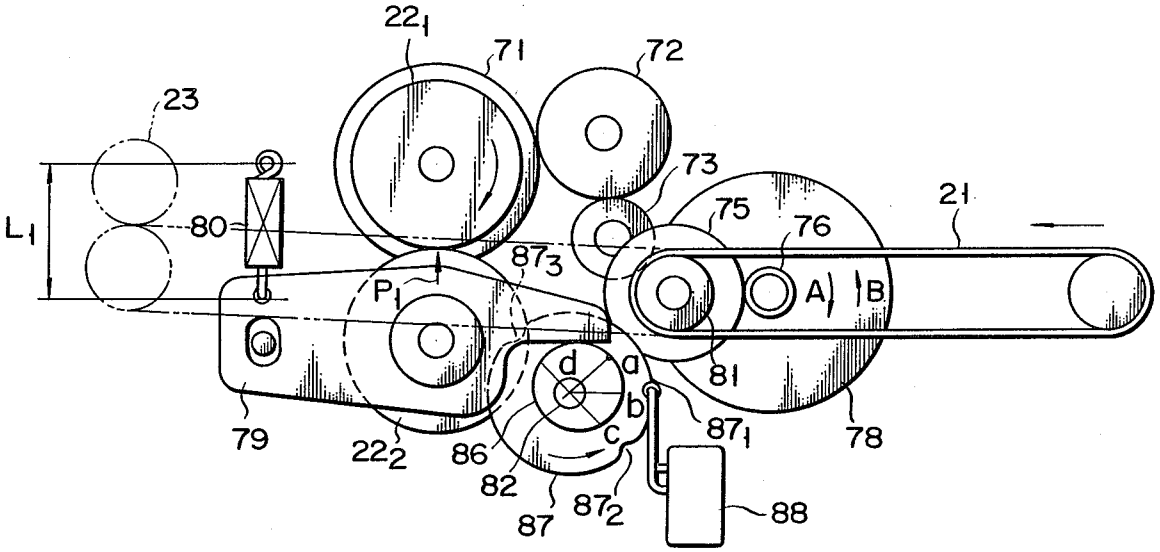

FIG. 16 shows a state wherein a relatively low pressure P1 is applied between the upper and lower heat rollers $22_1$ and $22_2$. In this state, the cam 86 is located at a position slightly before the upper dead point. In addition, elongation of the biasing springs 80 is weaker than that in the state shown in FIG. 14. Therefore, a pressure between the upper and lower heat rollers $22_1$ and $22_2$ is low. In this case, a position of the cam 87 is determined at a point j (i.e., the recess $87_1$) by the microswitch 88.

Assume that a length of the biasing springs 80 and pressure between the upper and lower heat rollers $22_1$ and $22_2$ in the state shown in FIG. 14 are respectively given by L2 and P2.

Also, assume that a length of the springs 80 and pressure between the rollers $22_1$ and $22_2$ in the state shown in FIG. 15 are respectively given by L3 and P3.

Furthermore, assume that a length of the springs 80 and pressure between the rollers $22_1$ and $22_2$ in the state shown in FIG. 16 are respectively given by L1 and P1. Thus, the elongation of the biasing springs 80 in the respective states satisfy the relation $L2>L1>L3$. Therefore, pressure between the heat rollers $22_1$ and $22_2$ in the respective states satisfy the relation $P2>P1>P3=0$.

Figure 17:
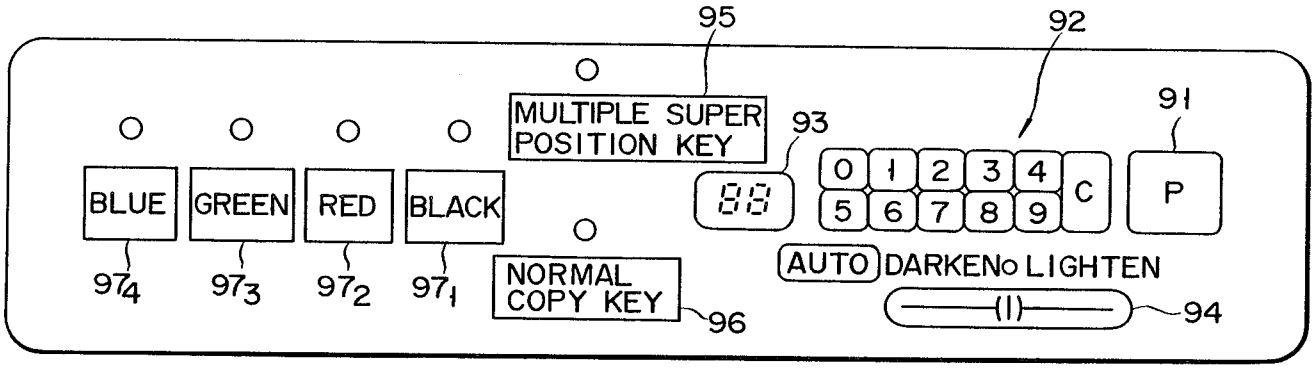
FIG. 17 is a plan view showing a control panel of the copy machine shown in FIG. 1.

FIG. 17 shows a control panel comprising a copy key 91 for supplying a copy start command, ten keys 92 for setting a copy number, a display 93 for displaying a setting number or the copy number, a copy density setting unit 94 for setting a copy density, and a multiple super position key 95 for designating the multiple super position mode. The control panel further comprises a normal copy key 96 for releasing the multiple super position mode so as to designate the normal copy mode, and color selection keys $97_1$, $97_2$, $97_3$ and $97_4$ for selecting copy colors corresponding to the developers $14_1$ to $14_4$, and the like. Note that the color selection keys $97_1$, $97_2$, $97_3$ and $97_4$ are provided for respectively selecting black toner (the developer $14_1$), red toner (the developer $14_2$), green toner (the developer $14_3$) and blue toner (the developer $14_4$).

Figure 18:
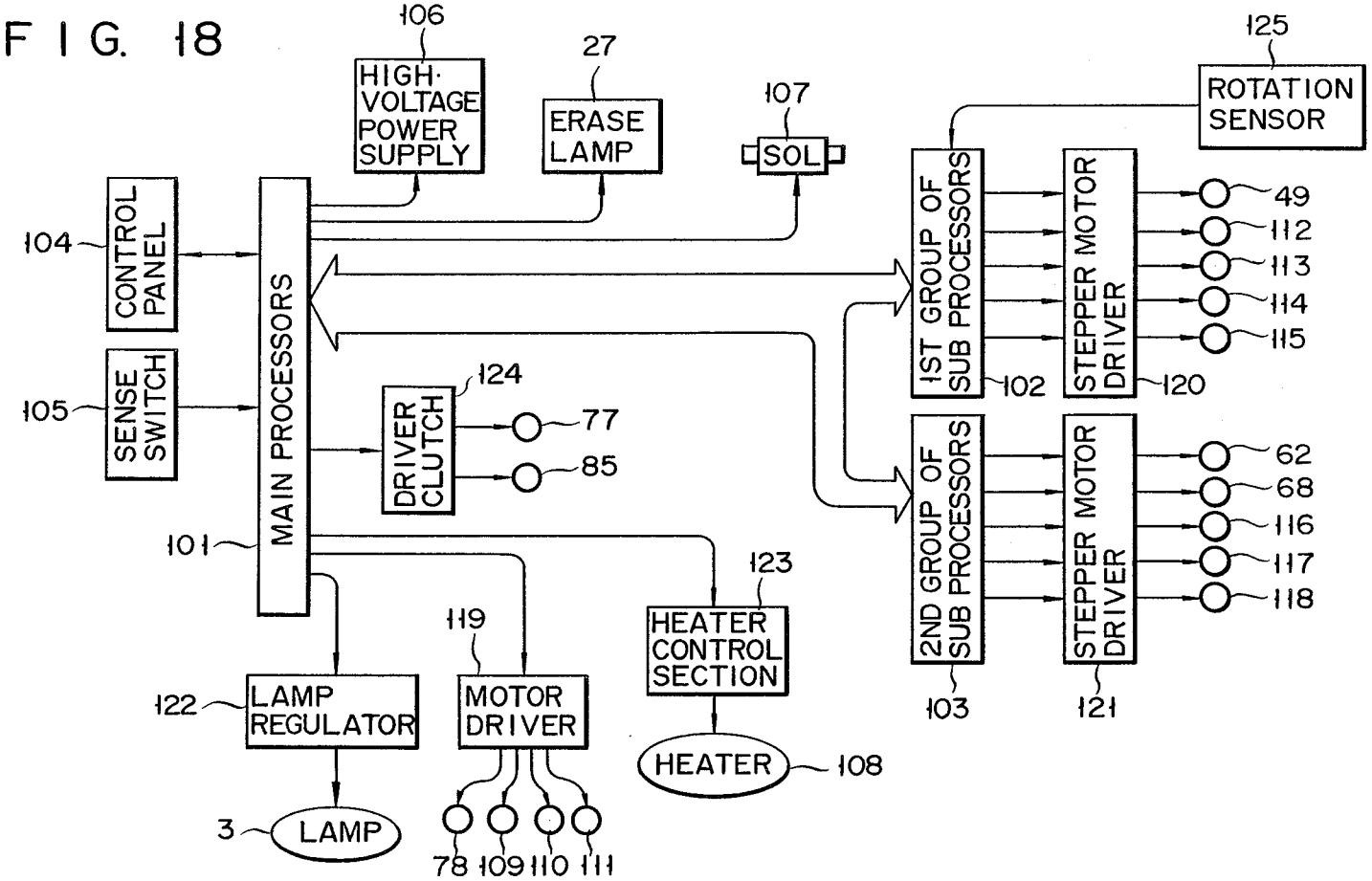
FIG. 18 is a block diagram showing a control circuit of the copy machine shown in FIG. 1.

FIG. 18 shows a block diagram of a control circuit mainly consisting of main processors 101 and first and second groups of subprocessors 102 and 103. The main processors 101 detect inputs from a control panel 104 and a sense switch 105 so as to control a high voltage power supply 106 for driving the erase lamp 27, the clutches 77 and 85 and various chargers, a solenoid 107 for driving the guide selector 28, the exposure lamp 3, a heater 108 for the heat roller $22_1$, the motors 49, 62, 68 and 78 and other motors 109 to 118, thus performing a copy operation. Note that the motor 109 is a paper exhaust motor for driving the exhaust roller 24 and the motor 110 is a conveyor motor for driving the conveyor 30. The motor 111 is a developer motor, e.g., a DC brushless motor for driving the gear 53. The motor 112 is a scanning motor for moving the mirrors 4 to 6, the motor 113 is a lens motor for moving the lens block 7, the motor 114 is a mirror motor for varying a distance (i.e., an optical path length) between the mirror 4 and the mirrors 5 and 6, and the motor 115 is a shutter motor for moving a shutter which adjusts a charging width of the photosensitive drum 12 by the charger 13. The motors 111 to 115 are pulse motors. Furthermore, the motor 116 is a drum motor for driving the photosensitive drum 12, the motor 117 is a moving motor for driving the moving means which moves the developing unit 14, and the motor 118 is a paper feed motor for driving the paper feed roller 16. The motors 116 to 118 are pulse motors.

The motors 78 and 109 to 111 are controlled by the main processors 101 through a motor driver 119. Similarly, the motors 49 and 112 to 115 are controlled by the first group of subprocessors 102 through a pulse motor driver 120. The motors 62, 68, 116 to 118 are controlled by the second group of subprocessors 103 through a pulse motor driver 121. The exposure lamp 3 is controlled by the main processors 101 through a lamp regulator 122. The heater 108 is controlled by the main processors 101 through a heater control section 123. The clutches 77 and 85 are controlled by the main processors 101 through a clutch driver 124. The main processor 101 supply commands for driving and stopping the respective motors to the first and second groups of subprocessors 102 and 103. The first and second groups of subprocessors 102 and 103 supply status signals representing driven and stopped states of the respective motors to the main processors 101. Positional data from a position sensor 125 for detecting the respective initial positions of the motors 49 and 112 to 115 is supplied to the first group of subprocessors 102.

Figure 19:
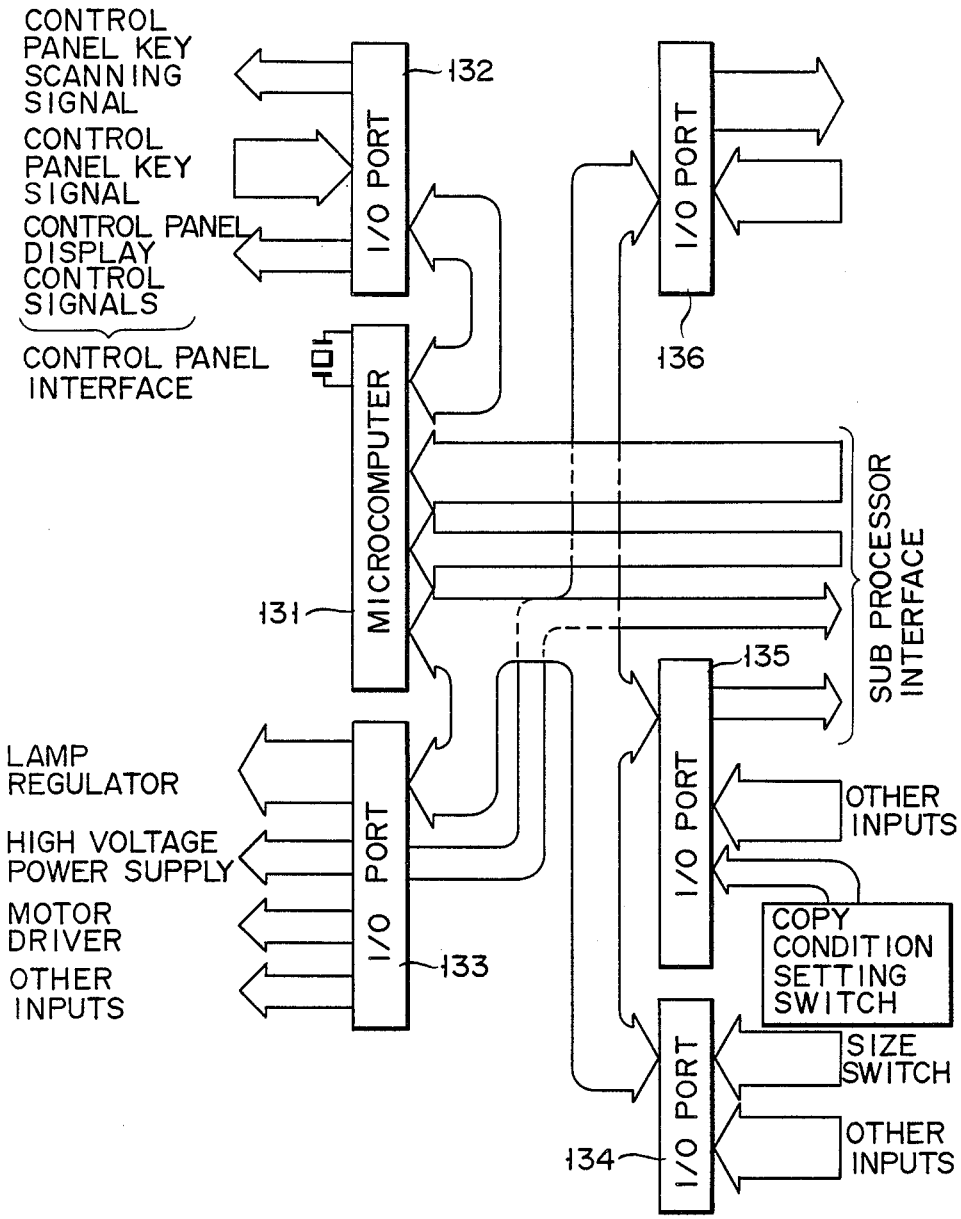
FIG. 19 is a block diagram showing a processor of the control circuit shown in FIG. 18.

FIG. 19 shows a block diagram of the main processors 101. In FIG. 19, reference numeral 131 denotes a one-chip microcomputer which performs key input detection and display control of the control panel 104 through an I/O port 132. The microcomputer 131 comprises I/O ports 133 to 136.

The high voltage power supply 106, the motor driver 119, the lamp regulator 122 and other inputs are connected to the I/O port 133. A size switch for detecting a paper size and other inputs are connected to the I/O port 134. A copy condition setting switch and other inputs are connected to the I/O port 135. Note that the I/O port 136 is an option.

Figure 20:
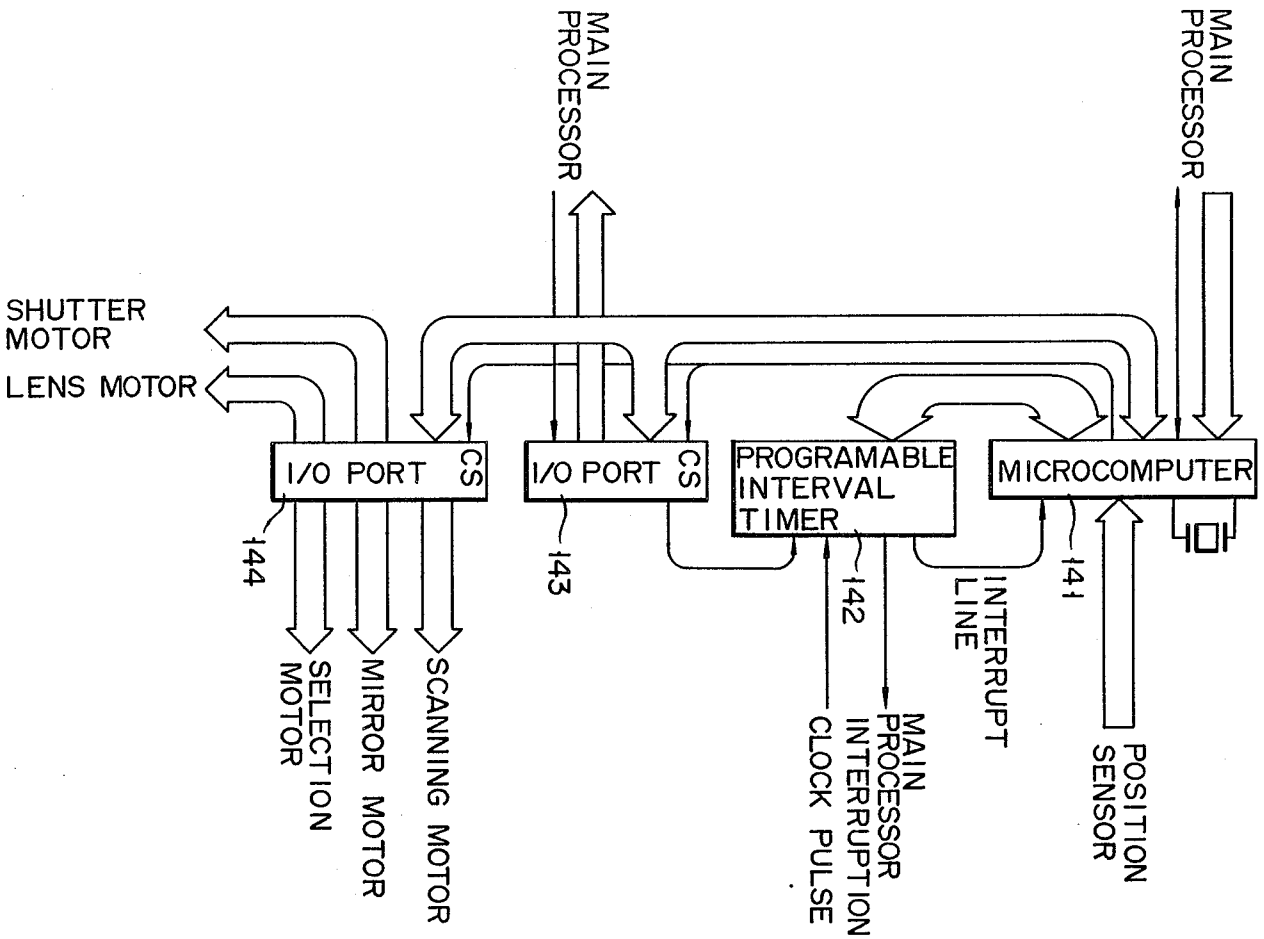
FIG. 20 is a block diagram showing a first group of subprocessors of the control circuit shown in FIG. 18.

. FIG. 20 shows an arrangement of the first group of subprocessors 102. In FIG. 20, reference numeral 141 denotes a microcomputer which is connected to the main processors 101; and 142, a programable interval timer for controlling respective switching intervals of the pulse motors. The microcomputer 141 sets a predetermined value in the timer 142 and the timer 142 counts in accordance with the predetermined value. When the timer 142 finishes counting, it generates an end pulse to an interrupt line of the microcomputer 141. A reference clock pulse is supplied to the timer 142. Positional data from the position sensor 125 is supplied to the microcomputer 141. I/O ports 143 and 144 are connected to the microcomputer 141. The motors 49 and 112 to 115 are connected to the I/O port 144 through the pulse motor driver 120. Note that the I/O port 143 is used for, e.g., generating status signals of the respective pulse motors to the main processor 101.

Figure 21:
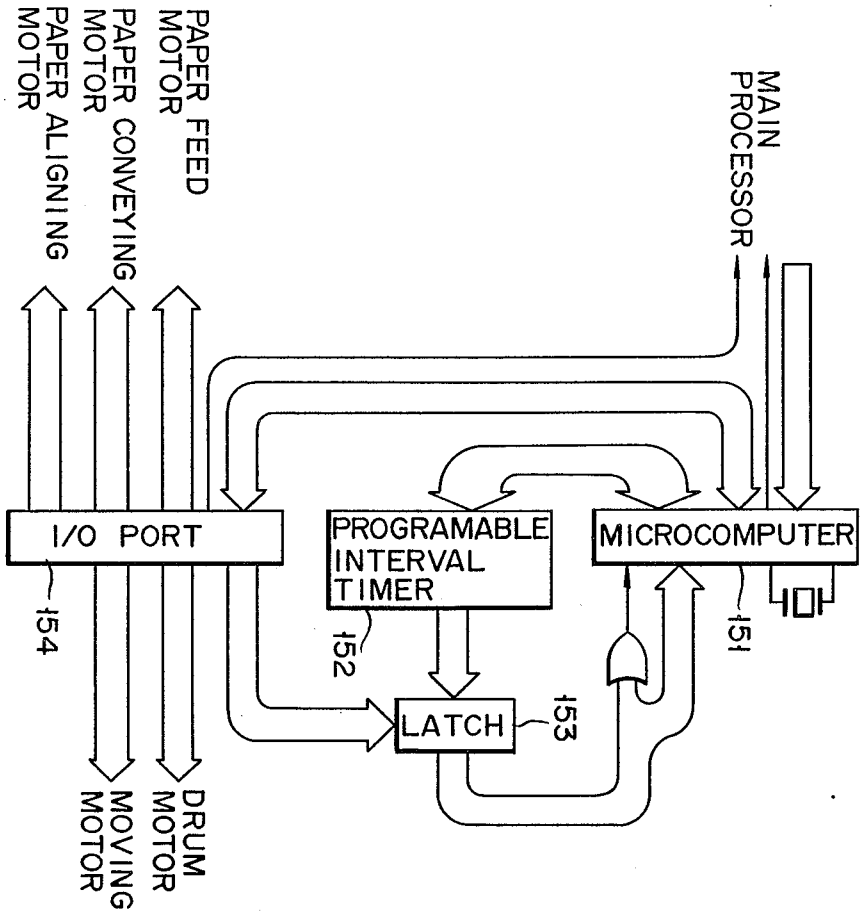
FIG. 21 is a block diagram showing a second group of subprocessors of the control circuit shown in FIG. 18.

FIG. 21 shows a block diagram showing the second group of subprocessors 103. Reference numeral 151 denotes a microcomputer which is connected to the main processors 101; and 152, a programable interval timer for controlling a switching interval of the pulse motors. When the microcomputer 151 sets a predetermined value in the timer 152, the timer 152 counts in accordance with the predetermined value. When the timer 152 finishes counting, it generates an end pulse. The end pulse is latched in a latch circuit 153 whose output is supplied to an interrupt line of the microcomputer 151 and an input line of the I/O port. An I/O port 154 is connected to the microcomputer 151. The motors 62, 68 and 116 to 118 are connected to the I/O port 154 through the pulse motor driver 121.

With such an arrangement, when the multiple super position key 95 is depressed on the control panel 104, the main processors 101 execute a program in the multiple super position mode in response to a signal therefrom. The main processors 101 operate the fixing motor 78 and control the clutches 77 and 85. The main processors set the pressure between the upper and lower heat rollers $22_1$ and $22_2$ at P1, and set the guide selector 28 at a position indicated by a solid line in FIG. 1. Next, an operator places a first document on the document table 2 and selects a desired copy color by means of the color selection keys $97_1$ to $97_4$. For example, assume that the color selection key $97_2$ is depressed in order to perform a red copy operation. The main processors 101 supply an ON signal of the moving motor 117 to the second group of subprocessors 103 in response to the signal from the control panel so as to select the developer which corresponds to the color selection key $97_2$ and stores red toner. In response to the ON signal, the second group of subprocessors 103 drives the moving motor 117 and moves the developing unit 14 in a direction away from the photosensitive drum 12 to set the developers in the state shown in FIG. 1. When movement of the developing unit 14 ends, the main processors 101 supply an ON signal of the selection motor 49 to the first group of subprocessors 102. In response to this ON signal, the first group of subprocessors 102 drives the selection motor 49 so as to rotate the rotating frame 42. The developers $14_1$ to $14_4$ revolve to remain horizontal and are stopped when the selected developer $14_2$ is at a position opposite to the photosensitive drum 12. When this revolving operation is finished, the main processors 101 supply the ON signal of the moving motor 117 to the second subprocessors 103 again so as to move the developing unit 14 toward the photosensitive drum 12. The selected developer is set adjacent to the photosensitive drum 12. In this manner, since the developing unit 14 is sufficiently spaced by a predetermined distance from the photosensitive drum 12, alignment of the developing unit 14 with respect to the photosensitive drum 12 can be precisely performed.

In this manner, the developer storing the designated color toner can be selected, and thus the red copy operation can be performed. When the copy key 91 on the control panel 104 is then depressed, the copy operation is started, thus performing the red copy operation by the developer $14_2$.

In other words, the document is exposed in accordance with the scanning operation, and an electrostatic latent image is formed on the photosensitive drum 12. The latent image is visualized by the developer $14_2$. The toner image is transferred to the paper sheet P fed from the cassette 15. In this case, the main processors 101 drive the fixing motor 78 and control the clutches 77 and 85 so as to rotate the conveyor belt 21 and the upper heat roller $22_1$. Thus, the paper sheet P on which the toner image is transferred is conveyed between the upper and lower heat rollers $22_1$ and $22_2$ by the conveyor belt 21 so as to be subjected to fixing. In this case, the pressure between the upper and lower heat rollers $22_1$ and $22_2$ is set at P1. Since the pressure P1 is smaller than the maximum pressure P2, the paper sheet P does not wrinkle when it passes between the rollers $22_1$ and $22_2$. When the paper sheet P after fixing is conveyed by the conveyor rollers 23, since the guide selector 28 is set at the position indicated by the solid line in FIG. 1, the paper sheet P is turned by the guide selector 28 and the paper guide path 29 into the conveyor 30. The paper sheet P is conveyed to a position in front of the register rollers 18 by the conveyor 30 and is stopped at this position, thus preparing for the next copy operation.

Next, a second document is placed on the document table 2. When the multiple super position operation is terminated in this state, the multiple super position key 95 can simply be depressed again so as to release the multiple super position mode. By the selecting operation described above, the developer storing, e.g., black toner, is selected and the black copy operation is performed. In this manner, when the multiple super position mode is released, the main processors 101 drive the fixing motor 78 and control the clutches 77 and 85 so as to set the pressure between the upper and lower heat rollers $22_1$ and $22_2$ at the maximum value P2. The main processors 101 turn off the solenoid 107 and set the selector 28 at a position indicated by a dotted line in FIG. 1. When the copy key 91 is depressed again, the copy operation is restarted in the same manner as described above. Thus, the black copy operation using the developer $14_1$ is performed. The black copy operation is performed so as to overlap the previous red copy operation. In this case, pressure between the upper and lower heat rollers $22_1$ and $22_2$ is set at P2, and the pressing and fixing operations are performed at this pressure. In other words, the maximum pressure P2 is applied at the final fixing operation. In this manner, when the paper sheet P, after an overlapping copy is conveyed by the conveyor rollers 23, since the guide selector 28 is set at the position indicated by the dotted line in FIG. 1, the paper sheet P is fed to the exhaust rollers 24 and exhausted onto the tray 25.

Note that when the multiple super position operation is performed in the multiple super position mode, the copy operation can be performed in the multiple super position mode without depressing the multiple super position key 95.

Figure 22:
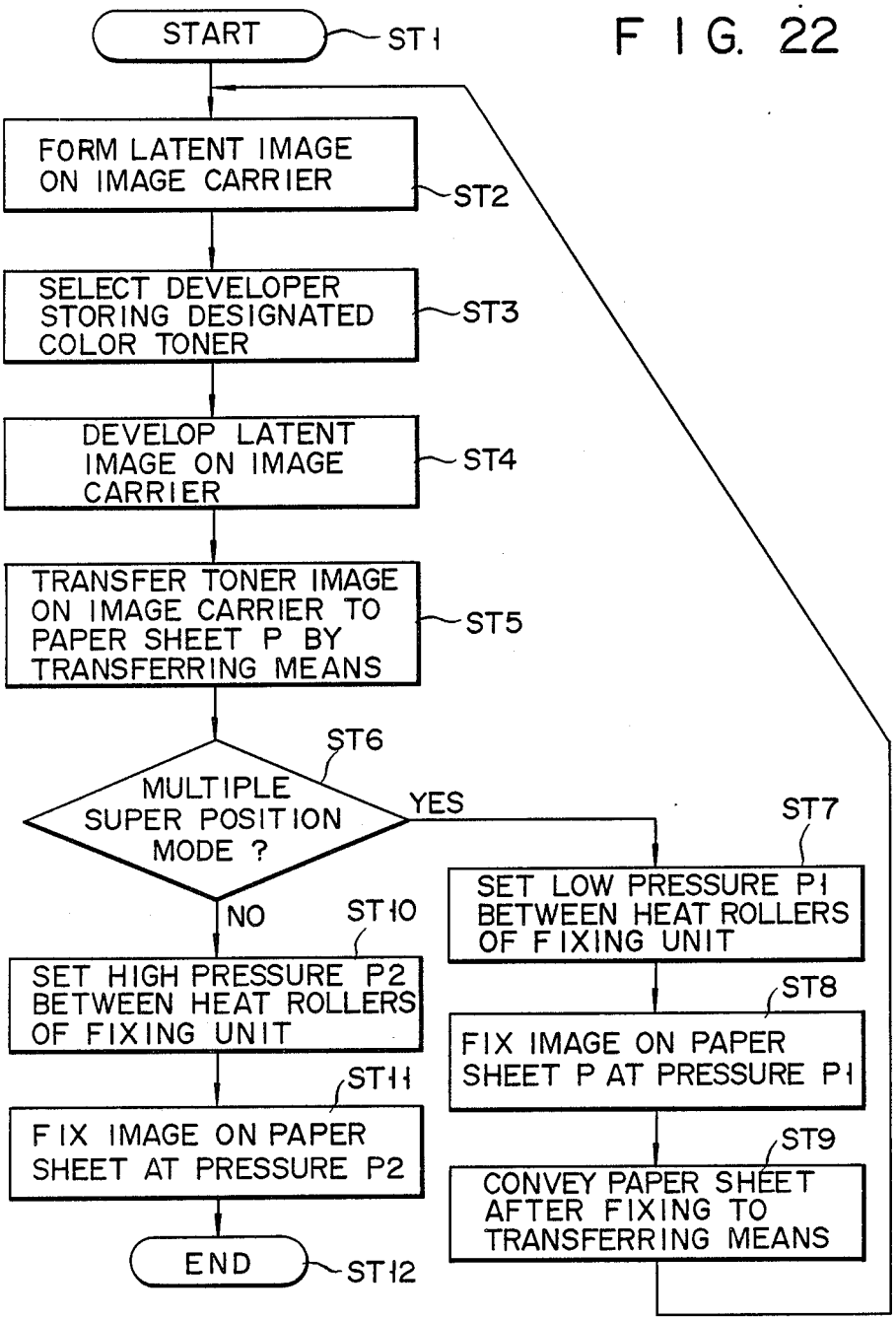
FIG. 22 is a flow chart for explaining a method of the present invention.

FIG. 22 shows a flow chart showing the overall control steps of the control circuit. In step ST1, the microcomputer starts a control operation. In step ST2, an electrostatic latent image is formed on an image carrier, i.e., the photosensitive drum 12. In step ST3, the developer storing the designated color toner is selected, and in step ST4 the latent image on the image carrier is developed by the selected developer. In step ST5, the image on the image carrier is transferred to the paper sheet by the transferring means. In step ST6, the microcomputer determines whether or not the multiple super position mode is set. If YES in step ST6, the lower pressure P1 between the upper and lower heat rollers $22_1$ and $22_2$ is selected in step ST7, and the image formed on the paper sheet P is fixed at the pressure P1 in step ST8. In step ST9, the paper sheet, after fixing, is conveyed to the transferring means and the flow returns to step ST2, thus performing the multiple super position operation.

Meanwhile, if NO in step ST6, the higher pressure P2 of the heat rollers $22_1$ and $22_2$ is set in step ST10, and the image on the paper sheet is fixed at the pressure P2 in step ST11. Thus, the flow ends in step ST12.

Figure 23:
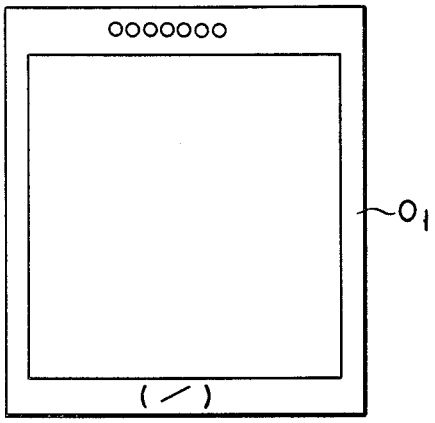
FIGS. 23 and 24 are views showing an example of a multiple super position
Figure 24:
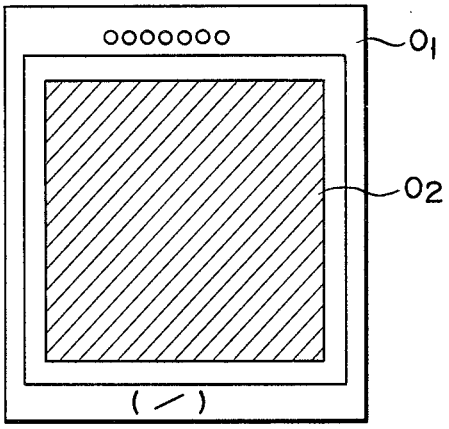

When the multiple super position operation is performed in this manner, a first document 01 is copied, as shown in FIG. 23, and a second document 02 can be copied to overlap thereon, as shown in FIG. 24. Thus, desired two-color images can be copied to overlap with each other. Note that the multiple super position operation can be continued without releasing the multiple super position mode so as to further overlap blue and green images thereon.

In the method as described above, for example, a styrene acrylic resin or a hot-melt resin in which polyester is mixed with a pigment is used as toner, the final fixing operation is performed at a heat roller surface temperature of 190° C.±5° C. at a radial load of about 45 kg. In the multiple super position mode, excluding the final fixing operation, the radial load is decreased to a range within which the toner image transferred to the paper sheet P is not peeled during conveying, thus preventing wrinkles of the paper sheet P. Therefore, even when the paper sheet P is circulated several times, it does not wrinkle, thus preventing a shift in position and a paper jam due to wrinkling. In addition, in the final fixing operation, since the toner image on the paper sheet P is fixed at sufficient pressure, poor fixing cannot occur. Therefore, images can be overlapped with satisfactory presicion.

Since theregister rollers 18 align the paper sheet P along the axial direction thereof, the paper sheet P can always be aligned at a constant position, and a shift in positions of images can be prevented, thus overlapping the images with high precision.

Furthermore, since a plurality of developers can be arranged, the multiple super position operation can be easily performed Since the developers are selected by revolving them, the desired developer can be easily and quickly selected with less vibration. The developers are revolved in a small area, thus effectively using minimum space and achieving a compact apparatus. In addition, since the developers can be kept horizontal during revolving, trouble caused by excessive movement of a developing agent can be avoided.

In the above embodiment, a multiple super position machine according to a method of the present invention is described. However, the present invention is not limited to this. The method of the present invention can be applied to a copy machine to perform a two-side copy operation for forming images on two sides of a single paper sheet by circulating the sheet.

Needless to say, in addition to such copy machines, the method of the present invention can also be applied to various image forming machines such as an electronic printer, a facsimile system and the like.

What is claimed is:

1. An image formed method comprising the steps of:

(a) selecting one of a multiple copy mode in which a plurality of superposing visible images may be formed on a single sheet of paper in a single image forming operation and a normal copy mode in which a single image may be formed on a single sheet of paper in a single image forming operation;

(b) forming an electrostatic latent image on an image carrier;

(c) developing the electrostatic latent image formed on the image carrier to form a visible image;

(d) transferring the visible image to a paper sheet by a transferring means;

(e) selectively applying the fixing pressure at one of relatively low and relatively high pressures according to whether the single or multiple copy mode has been set.

(f) fixing the transferred image on to a paper sheet by a common fixing means under the relatively high pressure of the normal copy mode has been selected, or under the relatively low pressure if the multiple copy has been selected;

(g) supplying said paper sheet to said common fixing means every time one of said superposing visible images is transferred onto the single paper sheet when said multiple copy mode is set; and (h) conveying the paper sheet with the fixed image thereon back to the transferring means if the multiple copy mode has been selected, whereby superimposed images may be formed on the paper sheet.

2. A method according to claim 1, wherein said step of developing includes the step in which the electrostatic latent image on said image carrier is developed by selecting one developer storing a desired color developing agent from a plurality of developers storing a plurality of color developing agents.

3. A method according to claim 1, further including the step of performing a image forming operation in a multiple copy mode on one surface of the paper sheet and thereafter performing a copy operation in normal copy mode on the other surface of the paper sheet so as to achieve a two-side copy operation.

4. An image forming method according to claim 1, further comprising the additional step of:

when a multiple copy mode has been selected, changing from the multiple copy mode to a normal copy mode after a final occurrence of said conveying step in an image operation, whereby only a final one of said plurality of images formed on a particular paper sheet will have its fixing step performed at a relatively high pressure, so that the paper sheet is less likely to be damaged.

5. An image forming apparatus, comprising:

an image carrier;

means for forming an electrostatic latent image on said image carrier;

means for developing said electrostatic latent image formed on said image carrier to form a visible image;

means for transferring said visible image to a paper sheet;

means for selectively setting oneof a multiple copy mode in which a plurality of superposing visible images are formed on a single paper sheet, and a normal copy mode;

a common fixing means for: (1) fixing said transferred image on said paper sheet at a relatively high pressure when said normal copy mode is set, and (2) fixing said transferred image on said paper sheet at a relatively low pressure when said multiple copy mode is set;

means for selectively applying the fixing pressure of the common fixing means at one of said relatively low and high pressures according to the mode selected by the setting means for selecting one of the multiple copy mode and the normal copy mode;

means for conveying said paper sheet back to said transferring means each time an image on the image carrier is transferred thereto when said multiple copy mode is set, to transfer each of the multiple superposed images to be formed on said paper sheet; and means for supplying said paper sheet to said common fixing means every time one of said superposing visible images is transferred on the paper sheet when said multiple copy mode is set.

6. Apparatus according to claim 5, wherein said developing means is also for selecting one developer storing a desired color developing agent from a plurality of developers storing a plurality of color developing agents.

7. Apparatus according to claim 5, further comprising controlling means for controlling said apparatus to perform a copy operation in said multiple copy mode on one surface of said paper sheet and thereafter to perform a copy operation in said normal copy mode on the other surface of said paper sheet so as to achieve a two-side copy operation.

8. An image forming apparatus according to claim 5, which further comprises means for releasing the multiple copy mode to a normal copy mode before the last transfer of multiple images on the paper sheet.

* * * * *